US005881424A

United States Patent [19]

Pleener

[11] Patent Number: 5,881,424

[45] Date of Patent: Mar. 16, 1999

[54] MOP

[76] Inventor: Mona Pleener, 2442 Legion St., Bellmore, N.Y. 11710

[21] Appl. No.: 989,658

[22] Filed: Dec. 12, 1997

[51] Int. Cl.[6] ..... A47L 13/12; A47L 13/14; A47L 13/146

[52] U.S. Cl. ..... 15/119.2; 15/121

[58] Field of Search ..... 15/118, 119.1, 15/119.2, 121

[56] References Cited

U.S. PATENT DOCUMENTS

| | | | |
|---|---|---|---|
| 2,201,079 | 5/1940 | Camden . | |
| 2,239,759 | 4/1941 | Schulenburg | 15/119.1 |
| 2,683,886 | 7/1954 | Neumann . | |
| 3,233,269 | 2/1966 | Scheffold | 15/119.2 |
| 3,721,502 | 3/1973 | Ognibene . | |
| 4,152,807 | 5/1979 | Smahlik . | |
| 4,809,387 | 3/1989 | Nakamura et al. | 15/119.1 |
| 5,655,248 | 8/1997 | Kieson et al. . | |

FOREIGN PATENT DOCUMENTS 807925 5/1936 France .

*Primary Examiner*—Terrence R. Till
*Attorney, Agent, or Firm*—Collard & Roe, P.C.

[57] ABSTRACT

A mop comprising an elongated handle having an oblong sponge mounted on one end for washing a flat surface such as a floor or window. A housing is mounted on the elongated handle above the oblong sponge. The handle is provided with a device for selectively retracting the sponge into the housing and simultaneously wringing the sponge. A wiper blade is mounted on the housing and is positioned to wipe the surface being mopped when the sponge is retracted within the housing. A roller is mounted to the mop and has a removable covering of absorbent, washable material. The roller contacts the surface being mopped and dries the surface when the sponge is retracted within the housing. The device eliminates all traces of water and soap residue from the mopped surface and thus eliminates unsightly water marks and streaks.

10 Claims, 4 Drawing Sheets

MOP

BACKGROUND OF THE INVENTION

1. Field of the Invention

This invention relates to a mop. In particular, this invention relates to a retractable mop having a wiper blade on one side and a drying roller on another side to eliminate excess water and soap residue.

2. The Prior Art

Various different styles of mops for cleaning floors, walls and glass have been used over time. The typical style that is commonly purchased by consumers for general floor cleaning consists of an oblong sponge mounted on a pole. There is usually a mechanism for wringing out the sponge without the user having to touch the wet sponge. This mechanism can be in the form of lateral rollers that extend to squeeze the sponge such as shown in U.S. Pat. No. 2,201,079 to Camden, or a bending apparatus that folds the sponge in half and presses it together.

These mops are adequate for general cleaning purposes, but often leave a wet, soapy residue on the surface being cleaned. Several attempts have been made to improve on the typical mop to reduce the residue. For example, U.S. Pat. No. 5,655,248 to Kieson et al. discloses a wiper for a wringer mop having rollers of the above-mentioned type. The wiper is attached to the lower portion of the mop handle and has a flexible blade that extends across one side of the sponge portion of the mop. The blade is of the "squeegee" type and wipes the floor clean of any residue after the sponge travels over the floor. The wiper is able to contact the floor when the mop is placed at an angle of about 135 degrees relative to the floor.

While this device is an improvement over the basic sponge mop, a squeegee type wiper can still leave significant water residue on the surface being cleaned. This residue can lead to unsightly spotting, especially with very smooth surfaces such as glass and polished marble and granite.

SUMMARY OF THE INVENTION

It is therefore an object of the present invention to provide an improved mop for cleaning flat surfaces that eliminates all water and soap residue.

It is another object of the present invention to provide an improved mop that is easy to use and does not require the user to touch any wet or dirty components of the mop.

It is yet another object of the present invention to provide an improved mop that is simple and inexpensive to manufacture.

These and other objects of the invention are achieved by a mop comprising an elongated handle having an oblong sponge mounted on one end for washing a flat surface such as a floor or window. A housing is mounted on the elongated handle above the oblong sponge. The handle is provided with a device for selectively retracting the sponge into the housing and simultaneously wringing the sponge. A flexible wiper blade is mounted on the housing and is positioned to wipe the surface being mopped when the sponge is retracted within the housing. The wiper blade is preferably made of rubber, but other suitable materials could also be envisioned.

A roller is mounted to the mop and has a removable covering of absorbent, washable material. The roller contacts the surface being mopped and dries the surface when the sponge is retracted within the housing. The roller cover is preferably a highly absorbent cotton material such as terry cloth. However, other materials and textures could also be used. The device eliminates all traces of water and soap residue from the mopped surface and thus eliminates unsightly water marks and streaks.

In a preferred embodiment, the roller is attached to the handle and is retractable up from the edge of the housing so that it does not touch the floor even when the sponge is retracted. It can be then lowered to dry the floor at any desired time. This keeps the roller from becoming wet and dirty unnecessarily. The retraction can be accomplished by a pole slidably mounted on the handle and connected to the roller. The pole can be slid up and down and fixed in either a retracted or extended position on the handle. Alternatively, the roller is removable so that it cannot become wet from liquid splashing up from the bucket during mopping. In a removable version, the pole can be snapped and unsnapped from the handle by any conventionally known means.

The handle is preferably hollow and has a movable shaft disposed inside. The shaft is connected to an oblong plate that is mounted to an upper surface of the sponge. The plate is hinged at a center section to form two sides for bending the sponge in half. There is at least one spring mounted to the shaft and the plate, for maintaining the plate and sponge in an unbent state when there is no pressure applied.

The sponge can be retracted inside the housing by pulling the shaft upward through the handle, which bends the plate and pushes the two sides of the sponge together. This action wrings out the sponge and forces it inside the housing. At this point, the wiper and the roller if extended are touching the mopped surface and can then be used to wipe and dry the mopped surface.

The mop preferably is equipped with a spring-loaded protrusion on the shaft so that pulling the shaft upward to retract the sponge into the housing causes the protrusion to spring out above the handle and prevent the shaft from moving downward. Inward pressure by the user's fingers allows the shaft to slide downward and the sponge to exit from the housing for further mopping.

An abrasive strip is preferably mounted along the rear bottom edge of the housing. This strip can be used to scrub particularly dirty areas when the sponge is retracted into the housing.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
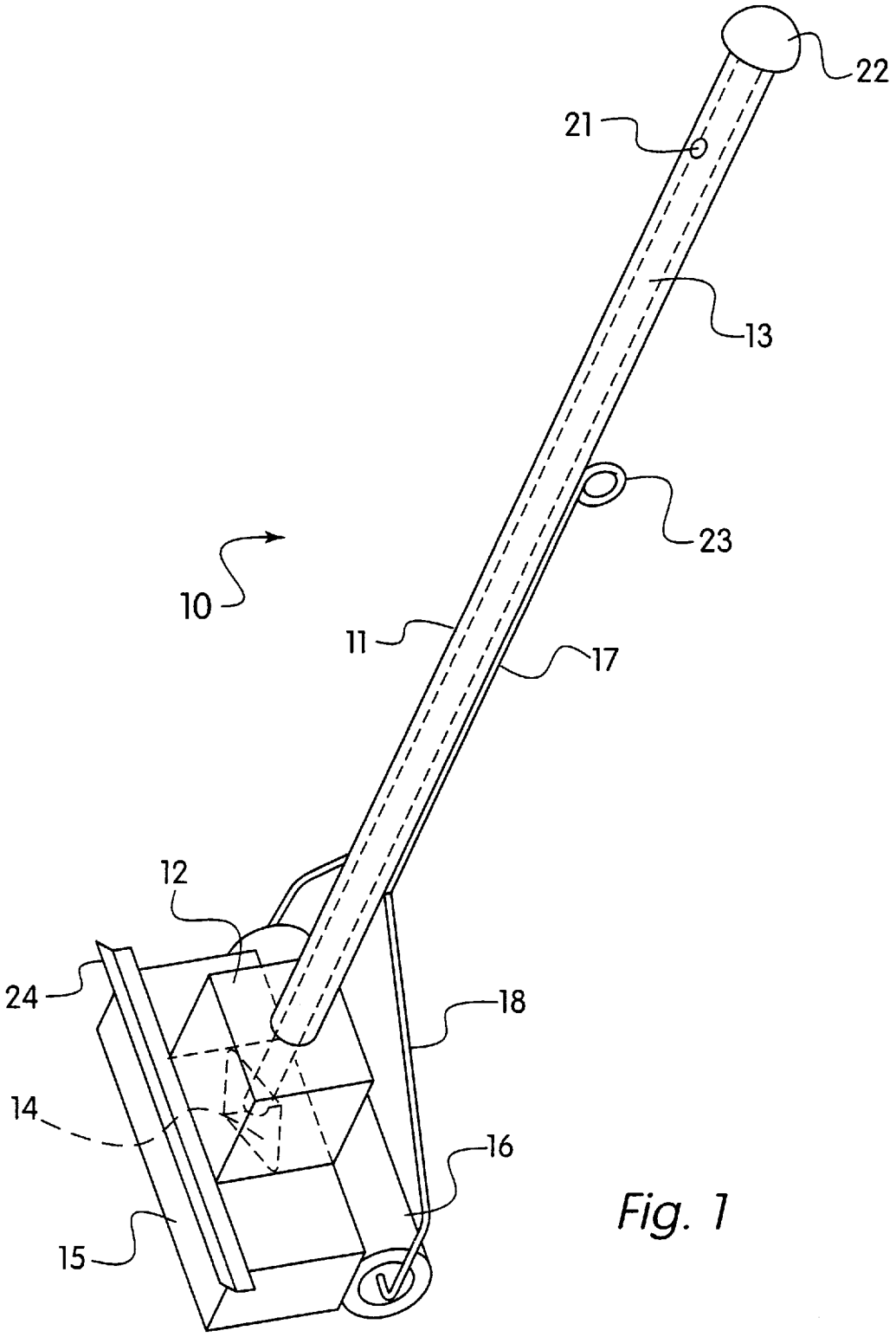
FIG. 1 shows a perspective view of the mop according to the invention.
Figure 2:
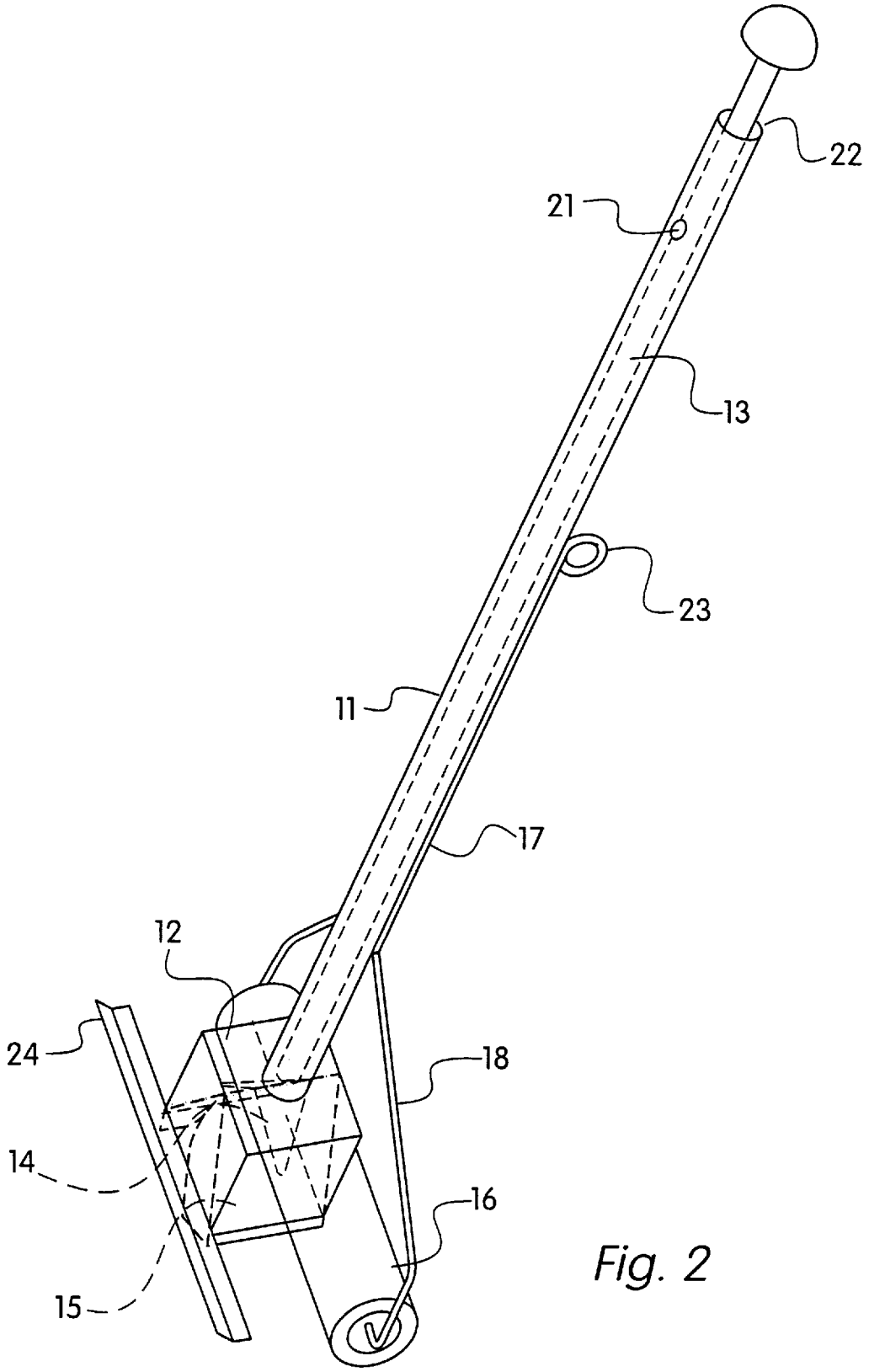
FIG. 2 shows a perspective view of the mop according to the invention with the sponge in a retracted state.

Referring now in detail to the drawings and, in particular, FIGS. 1 and 2, there is shown the mop according to the invention in two positions. Mop 10 is comprised of a handle 11 mounted to a housing 12. A shaft 13 having a top 22 is slidably disposed within handle 11, and is attached at its bottom end to metal plate 14. Metal plate 14 is mounted to the top side of an oblong sponge 15, which is wider than housing 12.

A flexible rubber wiper blade 24 is mounted to the front bottom edge of housing 12. Blade 24 extends beyond the width of housing 12 to be approximately equal to the width of sponge 15. Blade 24 extends slightly below the bottom edge of housing 12, but above sponge 15.

A drying roller 16 is mounted behind sponge 15, on a roller support 18. Roller support 18 is mounted on a sliding pole 17 that is slidably attached to handle 11. Roller 16 is equipped with a removable absorbent cotton roller cover, that can be washed between uses.

As shown in FIG. 2, shaft 13 can be pulled up from handle 11 to retract sponge 15 within housing 12. A spring-loaded protrusion 21 is mounted on shaft 13 and springs out from shaft 13 when protrusion 21 passes beyond the top of handle 11, to maintain sponge 15 in a retracted state. Protrusion 12 can then be pressed inward to allow shaft 13 to slide downward and extend sponge 15 when additional mopping is desired.

Figure 3:
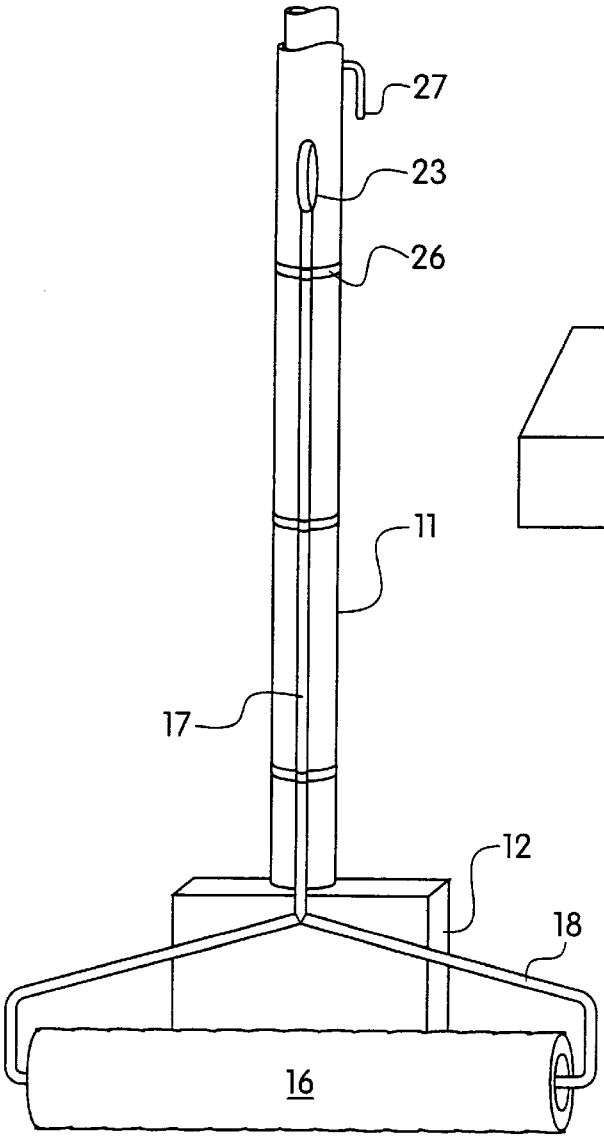
FIG. 3 shows a rear view of the mop having a roller retraction assembly.

When sponge 15 is retracted as shown in FIG. 2, wiper 24 and roller 16 can then be employed to wipe and dry the mopped surface. Roller 16 is preferably retractable, so that the entire surface can be wiped with wiper 24 before drying it with roller 16. Roller 16 can be retracted by sliding pole 17 up along handle 11, as shown in FIG. 3, which is a rear view of mop 10. Pole 17 has a protruding top 23 which can be used to fix roller 16 in a retracted state by engaging it with a pivoting clip 27 located at a higher position on handle 11. Any other desired means for retracting roller 16 or fixing pole 17 in place could also be used.

Figure 4:
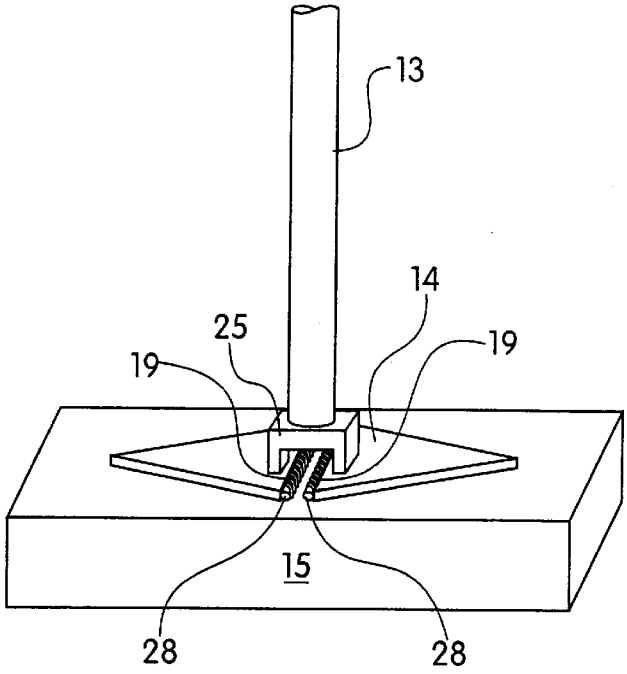
FIG. 4 shows a partial front view of the sponge wringing and retraction assembly according to the invention.

FIG. 4 shows a perspective view of the shaft and sponge assembly. Sponge 15 is attached to hinged plate 14, which is mounted to shaft 13 by brackets 25. Hinges 28 allow plate 14 to bend and squeeze the two sides of mop 15 together when mop 15 is pulled inside housing 12. When mop 15 is in the retracted state, two springs 19 located next to each hinge 28 keep mop 15 flat. While this mechanism is a commonly used type for wringing sponge mops, any other suitable mechanism could also be used, as long as mop 15 is folded to retract inside housing 12.

Figure 5:
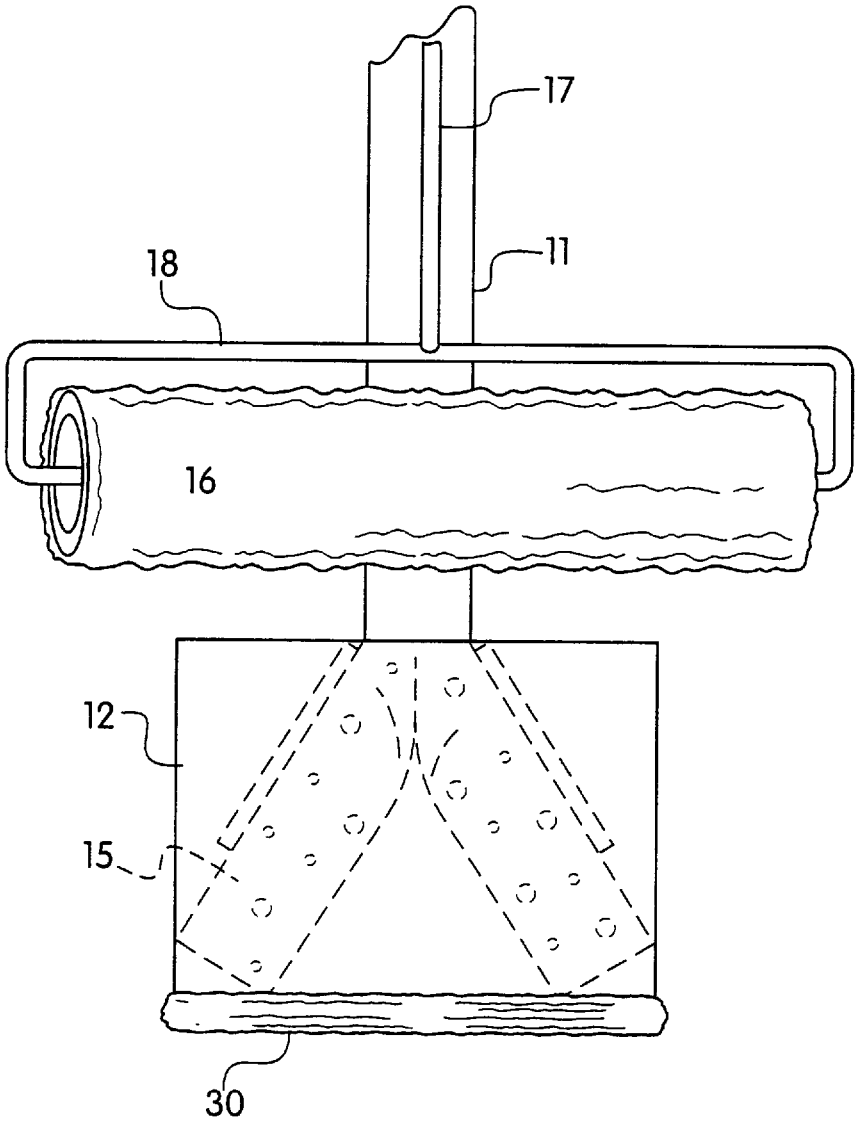
FIG. 5 shows a rear view of the mop according to the invention with the roller and sponge retracted.

As shown in FIG. 5, an abrasive strip 30 is mounted along the rear bottom edge of housing 12. Strip 30 contacts the surface being mopped when sponge 15 is retracted within housing 12. Strip 30 allows the user to scrub especially dirty areas or stuck-on dirt and debris with the mop according to the invention. After scrubbing with strip 30, sponge 15 can then be used to mop the area, with wiping by blade 24 and drying by roller 16 following.

Accordingly, while only one embodiment of the present invention has been shown and described, it is obvious that many changes and modifications may be made thereunto without departing from the spirit and scope of the invention.

What is claimed is:

1. A mop comprising:

an elongated handle:

an oblong sponge mounted on one end of said elongated handle for washing a surface;

a housing mounted on said handle above said oblong sponge, said housing having a front side, a rear side and an open end adjacent said sponge;

means on said handle for selectively retracting said sponge into said housing and simultaneously wringing said sponge;

a wiper blade mounted on the front side of said housing, said blade being positioned to wipe the surface being mopped when said sponge is retracted within said housing; and a roller mounted to said mop, said roller having a removable covering of absorbent, washable material, said roller contacting the surface being mopped and drying said surface when said sponge is retracted within said housing.

2. The mop according to claim 1, wherein said wiper blade is made of rubber.

3. The mop according to claim 1, wherein said roller is attached to said handle, and further comprising means on said handle for retracting and extending said roller.

4. The mop according to claim 3, wherein said means for retracting and extending said roller comprises a pole slidably mounted on said handle and connected to said roller, and means for fixing said pole in a desired position.

5. The mop according to claim 1, wherein handle is hollow and the means for retracting and wringing said sponge comprises:

a shaft mounted within said handle;

an oblong plate mounted to said shaft and an upper surface of said sponge, said plate being hinged at a center section to form two sides for bending the sponge in half;

at least one spring mounted to said shaft and said plate, said spring maintaining said plate in an unbent state;

wherein pulling said shaft upward through said handle bends said plate to wring said sponge, and retracts said sponge into said housing.

6. The mop according to claim 5, further comprising means for selectively maintaining said sponge in a retracted state within said housing.

7. The mop according to claim 6, wherein the means for maintaining said sponge in a retracted state comprises a spring-loaded protrusion on said shaft, wherein pulling said shaft upward to retract said sponge causes said protrusion to spring out above said handle prevent said shaft from moving downward, and wherein inward pressure on said protrusion allows said shaft to slide downward.

8. The mop according to claim 1, wherein said roller cover is made of cotton.

9. The mop according to claim 1, further comprising an abrasive strip mounted to the open end of the housing at the rear side of said housing.

10. The mop according to claim 1, wherein the roller is removably mounted to the mop.

* * * * *